US009511384B2

(12) United States Patent
Gandin

(10) Patent No.: US 9,511,384 B2
(45) Date of Patent: Dec. 6, 2016

(54) ATOMIZER

(71) Applicant: NAANDANJAIN IRRIGATION LTD., Kibbutz Na'an (IL)

(72) Inventor: Vitaly Gandin, Kiryat Shmona (IL)

(73) Assignee: NAANDANJAIN IRRIGATION LTD., Kibbutz Na'an (IL)

( * ) Notice: Subject to any disclaimer, the term of this patent is extended or adjusted under 35 U.S.C. 154(b) by 39 days.

(21) Appl. No.: 14/400,154

(22) PCT Filed: May 9, 2013

(86) PCT No.: PCT/IL2013/050397
§ 371 (c)(1),
(2) Date: Nov. 10, 2014

(87) PCT Pub. No.: WO2013/168161
PCT Pub. Date: Nov. 14, 2013

(65) Prior Publication Data

US 2015/0122916 A1 May 7, 2015

Related U.S. Application Data

(60) Provisional application No. 61/645,348, filed on May 10, 2012.

(51) Int. Cl.

| | |
|---|---|
| ***B05B 1/14*** | (2006.01) |
| ***B05B 1/16*** | (2006.01) |
| ***B05B 1/34*** | (2006.01) |

(52) U.S. Cl.
CPC ..... *B05B 1/3436* (2013.01); *B05B 1/14* (2013.01)

(58) Field of Classification Search
CPC ..... B05B 1/14; B05B 1/16; B05B 1/43; B05B 1/3431
USPC ..... 239/468, 469, 471, 463, 394, 487, 589.1
See application file for complete search history.

(56) References Cited

U.S. PATENT DOCUMENTS

| | | | | |
|---|---|---|---|---|
| 2,989,251 | A * | 6/1961 | Focht | B05B 1/3431 222/562 |
| 3,319,894 | A * | 5/1967 | Cooprider | B05B 1/3431 222/545 |
| 4,185,777 | A * | 1/1980 | Bauer | B05B 1/08 239/394 |

(Continued)

FOREIGN PATENT DOCUMENTS

| | | | |
|---|---|---|---|
| CN | 101098758 | A | 1/2008 |
| CN | 202123018 | U | 1/2012 |

(Continued)

OTHER PUBLICATIONS

International Search Report for International Application No. PCT/IL2013/050397, two pages, mailed Aug. 9, 2013.

*Primary Examiner* — Arthur O Hall
*Assistant Examiner* — Joseph A Greenlund
(74) *Attorney, Agent, or Firm* — Vorys, Sater, Seymour & Pease LLP

(57) ABSTRACT

Provided is a liquid atomizer including a housing fitted with an inlet connectable to a liquid supply line. The housing can include a cavity with a longitudinal axis in flow communication with the inlet, at least one opening for emitting atomized liquid, and at least one vortex generating member formed with a vortex generating path in fluid communication with the cavity.

20 Claims, 13 Drawing Sheets

(56) References Cited

U.S. PATENT DOCUMENTS

| | | | | | |
|---|---|---|---|---|---|
| 4,738,401 | A * | 4/1988 | Filicicchia | B05B 1/3415 | 239/487 |
| 4,970,865 | A * | 11/1990 | Shekelton | F23D 11/38 | 239/533.9 |
| 5,845,845 | A * | 12/1998 | Merke | F15C 1/22 | 239/1 |
| 6,637,673 | B1 * | 10/2003 | Zur | B05B 1/14 | 239/402 |
| 6,983,896 | B2 * | 1/2006 | Zur | B05B 1/14 | 239/463 |
| 7,111,800 | B2 * | 9/2006 | Berning | B05B 1/08 | 137/809 |
| 7,198,201 | B2 * | 4/2007 | Bowman | B05B 1/3436 | 216/100 |
| 7,320,440 | B2 * | 1/2008 | Prociw | F23D 11/24 | 239/402 |
| 7,354,008 | B2 * | 4/2008 | Hester | B05B 1/08 | 239/333 |
| 8,205,812 | B2 * | 6/2012 | Hester | B05B 1/08 | 137/814 |
| 8,313,045 | B2 * | 11/2012 | Levitsky | B05B 1/3426 | 239/468 |
| 2006/0108442 | A1 * | 5/2006 | Russell | B05B 1/08 | 239/102.1 |
| 2008/0093392 | A1 * | 4/2008 | Abduljalil | B05B 1/3426 | 222/394 |

FOREIGN PATENT DOCUMENTS

| | | | | |
|---|---|---|---|---|
| DE | 1 010 466 B | | 6/1957 | |
| DE | 1010466 B | * | 6/1957 | B05B 1/14 |
| EP | 1 106 260 A2 | | 6/2001 | |
| WO | 01/64352 A1 | | 9/2001 | |

* cited by examiner

ATOMIZER

FIELD OF THE INVENTION

This invention is generally in the field of liquid atomizers and in particular it is concerned with atomizers for agricultural and domestic use.

BACKGROUND OF THE INVENTION

The term "atomizer" as used herein in the specification and claims refers collectively to a device capable of emitting a fine mist of liquid. Such devices are often referred to in the art also as foggers, sprayers, mist devices, humidifiers, rooting etc.

Atomizers used in agriculture and for domestic purposes serve for conditioning the environment both by increasing humidity such as in greenhouses and tropical gardens, for irrigation and for cooling. A variety of atomizers are known, referred to as rotary-cup atomizers, air blast/air assist etc. The present invention is concerned with pressure atomizers.

Cooling by atomized liquid is obtained by forcing a liquid, typically water, through specially designed nozzles so as to obtain a fog of ultra fine water droplets. The liquid droplets absorb heat energy of the environment and evaporate, whereby the energy (heat) consumed for converting the liquid into gas (vapor) is extracted from the environment, thus cooling the air.

The amount of moisture in the air divided by the maximum amount of moisture there could be absorbed at the same temperature (relative humidity) is a significant parameter in determining cooling potential. The lower the relative humidity, the more liquid can be vaporized, thus the more heat can be removed from the environment. Evaporative cooling can be used in most geographical zones owing to the fact that when temperature reaches its peak during day, relative humidity is normally at its lowest. For this reason, evaporative cooling is commonly used in many zones over the world.

Liquid atomizers are at times, used also as frost protectors by creating a mist layer above the agricultural growth, thus preventing frost from damaging the crops.

Pressure atomizers are commonly in use and typically comprise a housing fitted with at least one outlet nozzle, a core member associated with each nozzle for generating a vortex (often referred to in the art as "swirl") and a strainer/washer member packed together by screw coupling of the nozzle to the housing. The atomized spray is obtained by guiding a liquid jet through a path causing the jet to swirl and upon exiting through a fine outlet nozzle, an atomized spray is emitted.

Typically, each outlet nozzle is associated with a single housing and where covering a large area with mist is required, thus several such housing may be mounted on a splitting element, each such outlet nozzle being directed to a different direction and said splitting element being connected in turn to a liquid supply line.

SUMMARY OF THE INVENTION

The subject matter of the present application provides a liquid atomizer for use in agriculture and for domestic use and is aimed, according to some examples, at providing an atomizer comprising a reduced number of components.

According to one aspect of the subject matter of the present application there is provided a liquid atomizer comprising a housing fitted with an inlet connectable to a liquid supply line and a cavity being in flow communication with the inlet, said cavity having a longitudinal axis; the housing comprising at least one opening for emitting atomized liquid; and at least one vortex generating member formed with a vortex generating path being in flow communication with the cavity and extending opposite a respective opening of the housing; said at least one vortex generating member having an inside surface facing said cavity and an opposite, outside surface facing away from said cavity, the inside surface of the vortex generating member being associated with the vortex generating path and comprises at least one outlet nozzle being in fluid flow communication with said vortex generating path via an opening extending between said inside surface and said outside surface, said vortex generating path configured for generating a liquid vortex directed towards said opening to be emitted from said outlet nozzle generally along the transverse direction.

The term 'transverse' should be understood here as being angled (not necessarily perpendicular) to the axis, i.e. not parallel thereto.

In accordance with a specific embodiment, the housing can be fitted with a plurality of such vortex generating members, so that, when fitted within the liquid atomizer, the members are generally radially about the axis of the housing is coaxial with the housing. In addition, at least one of the plurality of vortex generating members can be sealingly received without the housing.

In connection with the above embodiment, the peripheral portion can be formed with a plurality of openings, the number of said openings corresponding to the number of outlet nozzles formed in the vortex generating members.

The openings formed in the peripheral portion are typically of circular shape. However, it is appreciated that other opening shapes can be used for providing a desired for pattern emitted by the liquid atomizer.

According to a particular example, the vortex generating member is configured for being snapingly fixed to the housing and can be displaced into other functional positions. In particular, the inner surface of the vortex generating member can be configured to sealingly bear against corresponding inner walls of the housing, thus preventing liquid flow between the walls of the vortex generating member and the housing. However, a sealing member may be introduced between the vortex generating member and the housing.

Under the above example, the vortex generating path formed on the inner surface of the vortex generating member is sealingly delimited on one side by the body of the vortex generating member and on the other side by an inner wall of the housing. This arrangement allows directing fluid flow into the vortex generating path and increase efficiency thereof.

In accordance with the above example, the outer surface of the vortex generating member can sealingly bear against inner surfaces of the peripheral portion, and in such a way that the outlet nozzle of the vortex generating member is aligned with the opening of the peripheral portion.

It is appreciated that in accordance with the above aspect, the vortex generating member is already formed with an outlet nozzle configured for directing the fluid emitted through the opening, and that the opening of the peripheral portion should simply be big enough so as not to obstruct the fluid flow. In other words, the opening of the peripheral portion plays no role in forming the fluid flow emitted from the vortex generating path.

The plurality of vortex generating members can be separate from one another, or alternatively, be integrally formed with one another in a flexible manner. More specifically, the plurality of vortex generating members can be in the form of a single body with living hinge portions being formed between the vortex generating members to allow shaping the single body into a shape corresponding to that of the housing. It is appreciated that it can be more economically efficient and industrially simple to produce such a single body and assemble it to form the atomizer, rather than forming separate vortex generating members.

Furthermore, it is appreciated that an arrangement can be provided wherein the outlet of some of the vortex generating members is selectively closed in order to allow selective emission of fluid from the atomizer. For example, for a liquid atomizer with four vortex generating members, the outlet holes of three of the members can be open and functional, while the fourth can be selectively closed.

Furthermore, if the vortex generating members are separate, it can be possible to replace one or several of the vortex generating members with a 'dummy' member which has no outlet hole, thereby selectively determining through which openings of the liquid atomizer fluid will be discharged.

In accordance with one arrangement, the vortex generating path has an R or P like cross-section with the center of the round portion extending opposite the respective outlet nozzle and wherein the respective leg portions of the R and P like shapes constitute an opening of the path being in fluid communication with the inlet of the housing. In accordance with a second arrangement, the vortex generating path has a cochlea-like (spiral) cross-section with the center thereof extending opposite the respective outlet nozzle.

According to a variation of the above embodiments, the vortex generating path is formed with two (or more) leg portions for increasing the flow rate, the leg portions extending from an edge of the vortex generating member which is in flow communication with the cavity, or have at least one leg being in flow communication with the cavity via a hollow formed in the vortex generating member which is in flow communication with the cavity.

In accordance with another variation of the invention, the vortex generating member comprises a plurality of vortex generating paths and a plurality of outlet nozzles.

The arrangement of the liquid atomizer in accordance with the subject matter of the present application allows reducing the number of components wherein each housing is fitted with a single vortex generating member whereby a single housing is required for several outlet nozzles. According to a specific design embodiment, the inlet can also be provided with a pressure threshold valve received before or after the inlet. The pressure threshold valve can be received within the cavity of the liquid atomizer. In accordance with one such design, the pressure threshold valve comprises a closure member biased against the inlet of the housing.

In accordance with another embodiment, the pressure threshold valve is a leakage preventing device (LPD), wherein the closure member is spring biased against the inlet of the housing and has a piston rod connecting it with a piston, said piston being displaceable along a corresponding cylinder, which is in flow communication with the cavity. The LPD arrangement provides for opening of the closure member at a predetermined pressure threshold wherein the inlet is rapidly opened into a maximal open stage. This may be obtained by a structure in which the piston is sealingly displaceable within the cylinder and wherein liquid entering the cavity applies force on the piston in a direction entailing displacement of the closure member away from the inlet.

In accordance with such an embodiment, it is desired that the cylinder is vented to the atmosphere. In accordance with a modification of the invention, the piston is displaceable against a membrane fitted at an end of the cylinder.

BRIEF DESCRIPTION OF THE DRAWINGS

In order to understand the invention and to see how it may be carried out in practice, embodiments will now be described, by way of non-limiting example only, with reference to the accompanying drawings, in which.

DETAILED DESCRIPTION OF EMBODIMENTS

Figure 1A:
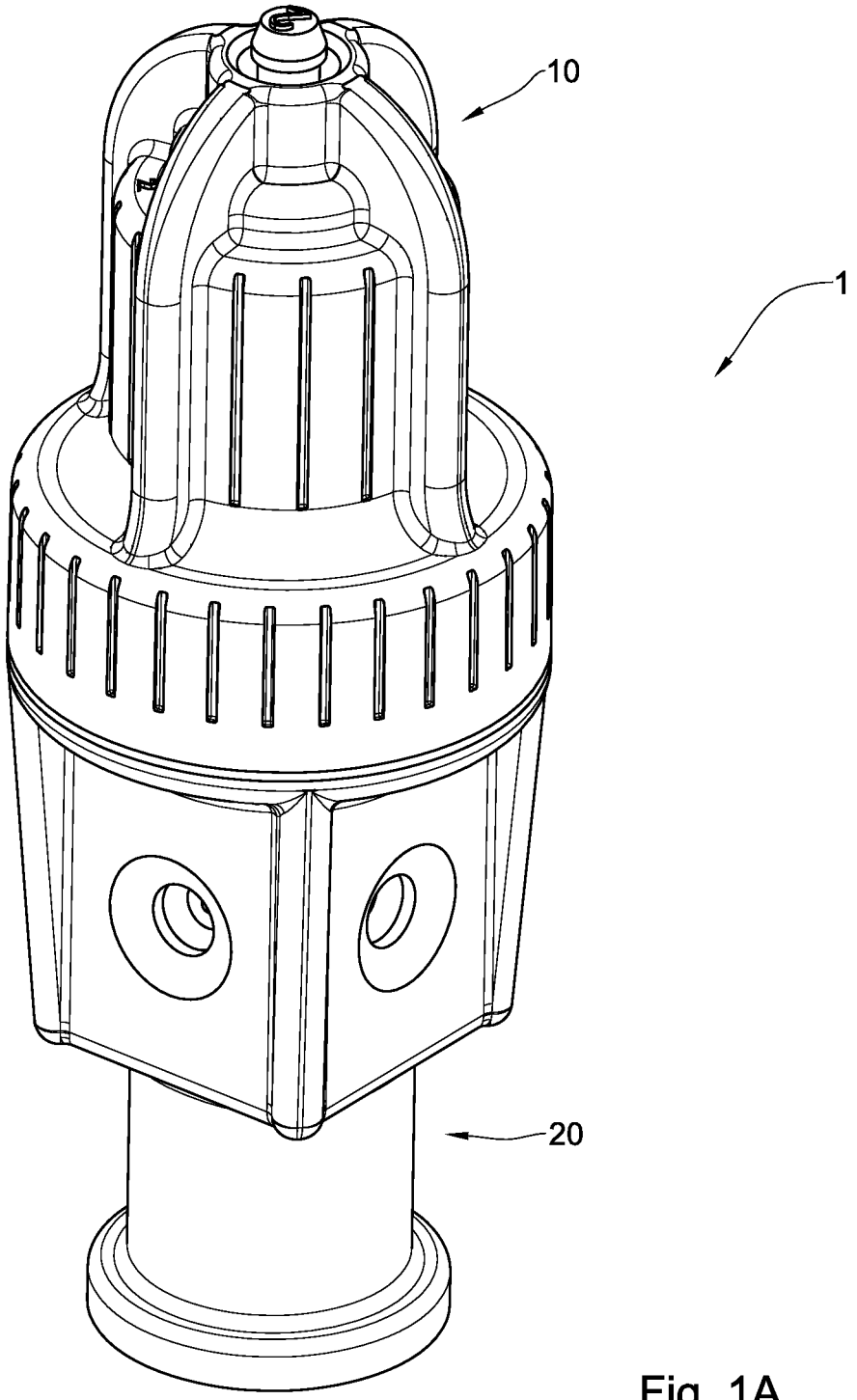
FIG. 1A is a schematic isometric view of a liquid atomizer according to the subject matter of the present application.
Figures 1B, 1C:
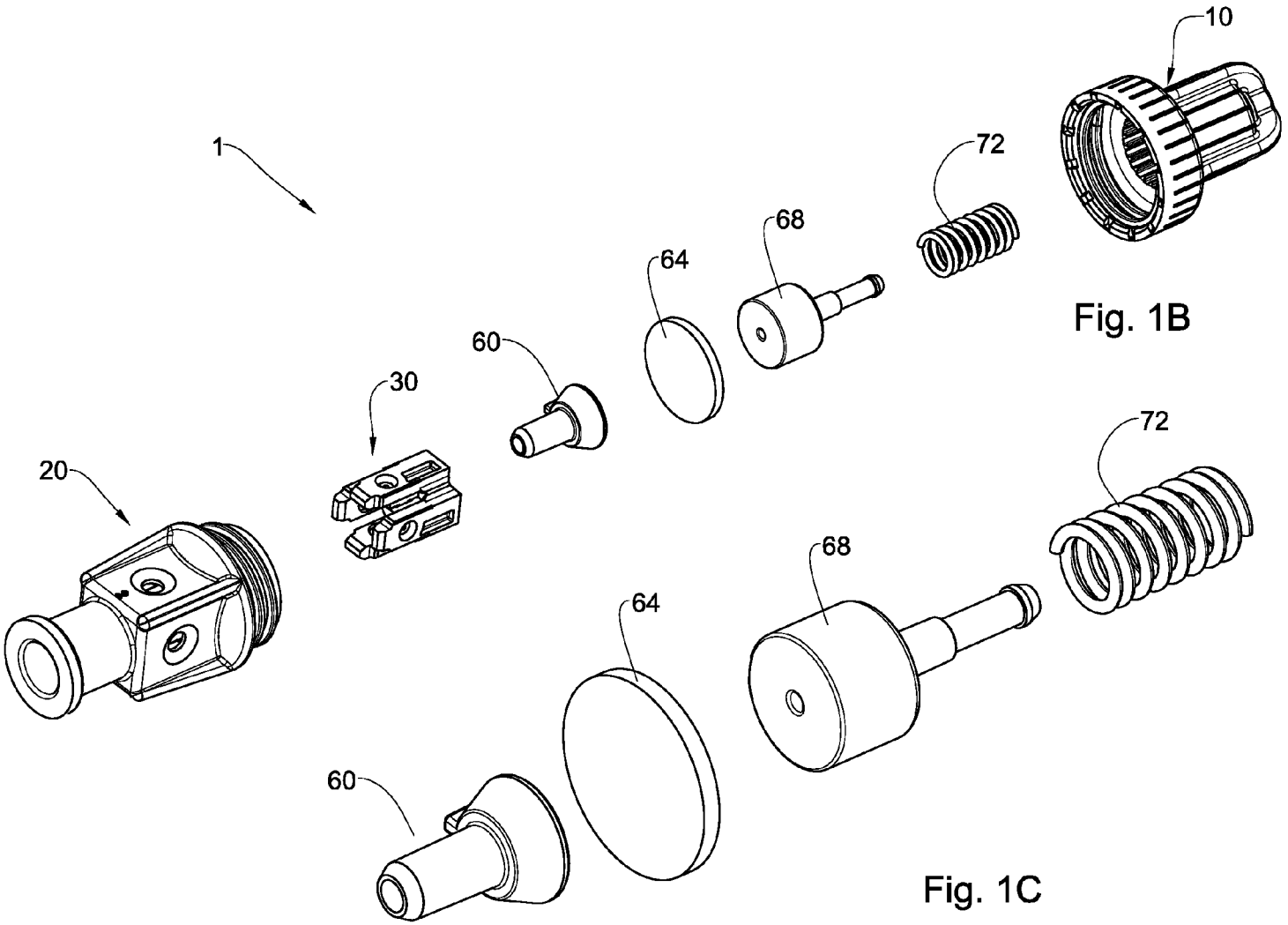
FIG. 1B is a schematic exploded isometric view of the atomizer shown in FIG. 1A.
FIG. 1C is a schematic enlarged view of a portion of the atomizer shown in FIG. 1B.
Figure 4A:
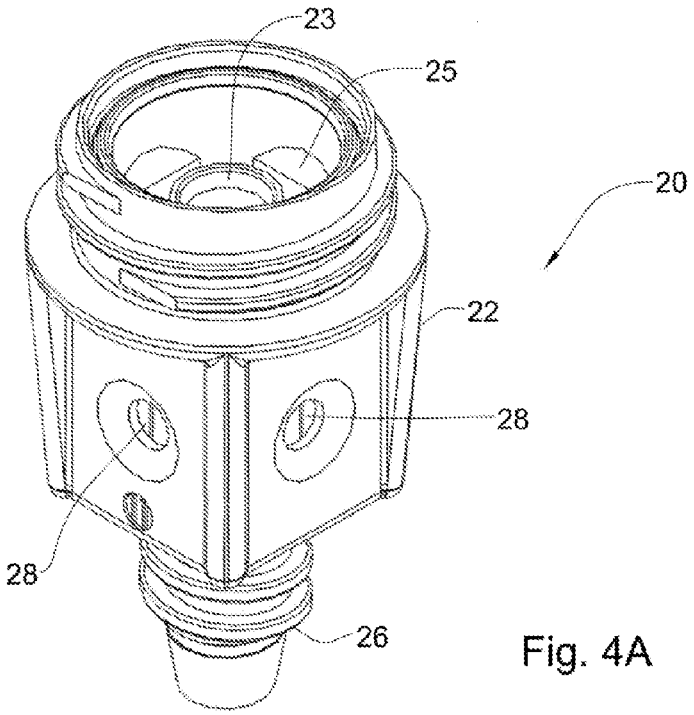
FIGS. 4A to 4D are schematic top isometric, front, bottom and bottom isometric views of a housing of the atomizer shown in FIG. 2B.
Figure 4B:
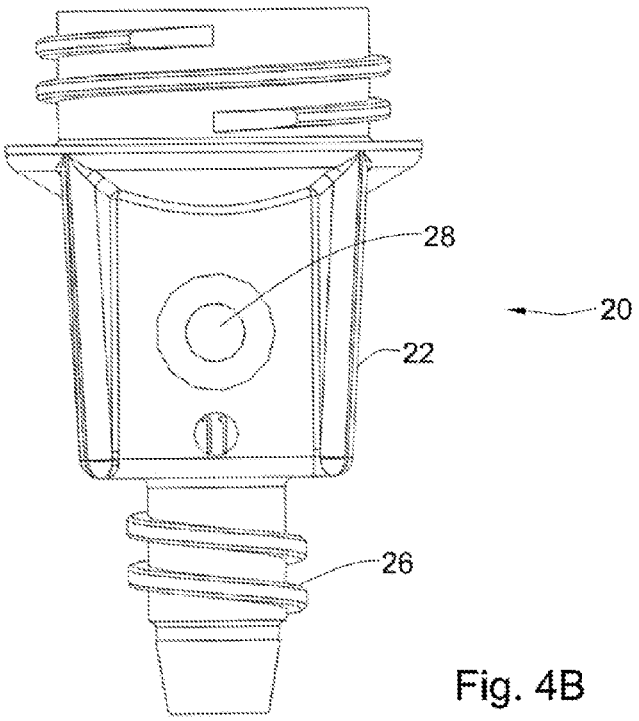

With reference to FIGS. 1 A to 1C, an atomizer generally designated 1 is shown comprising an inlet cap 10 and a housing 20. The inlet cap 10 is cylindrical and is configured for being in flow communication with an inlet 26 of the housing 20 (shown FIG. 4B), which may be attached by known means (press fit, screw threading, etc.) to a water supply line (not shown).

The cap 10 is further configured for accommodating therein a Leakage Preventing Device (LPD), including a biasing spring 72, plunger 68, a diaphragm 64 and a stem 60.

Figure 2A:
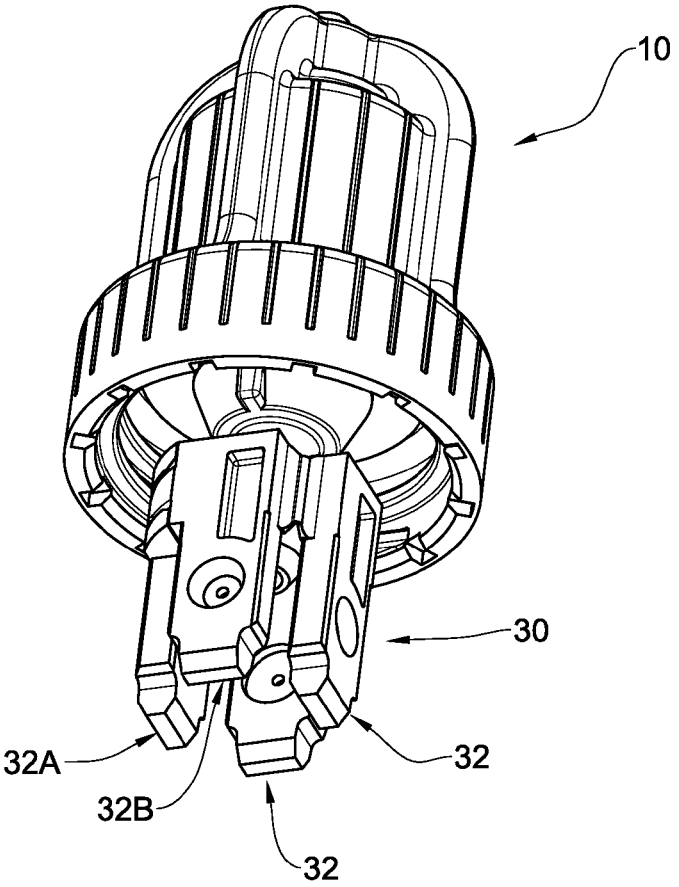
FIG. 2A is a schematic isometric view of the atomizer shown in FIG. 1A, with a housing thereof being removed.

With reference to FIG. 2A, the atomizer 1 accommodates a vortex generating unit, generally being designated as 30, and comprising four vortex generating members 32.

With reference to FIGS. 5A to 7D, the vortex generating members 32 of the vortex generating unit 30 are formed together as a single body with live hinge portions 33 formed between each two neighboring vortex generating members 32.

Figure 5A:
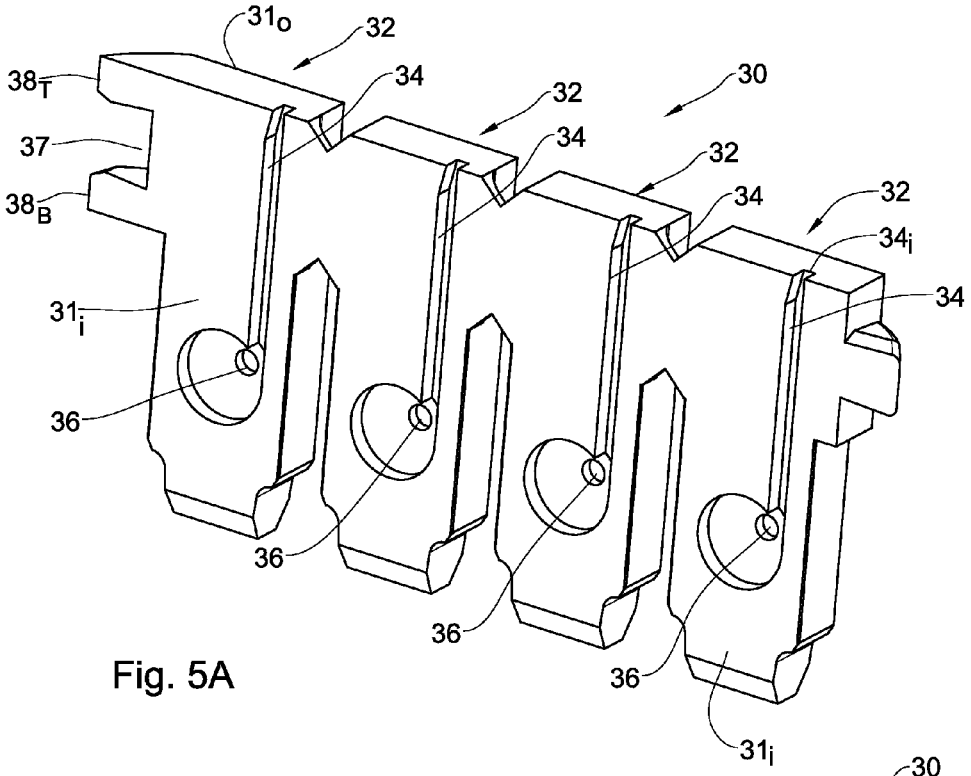
FIGS. 5A to 5D are schematic front isometric, front, rear isometric and rear views of a spread vortex generating member array used in the atomizer shown in FIGS. 1A and 1B.
Figure 5B:
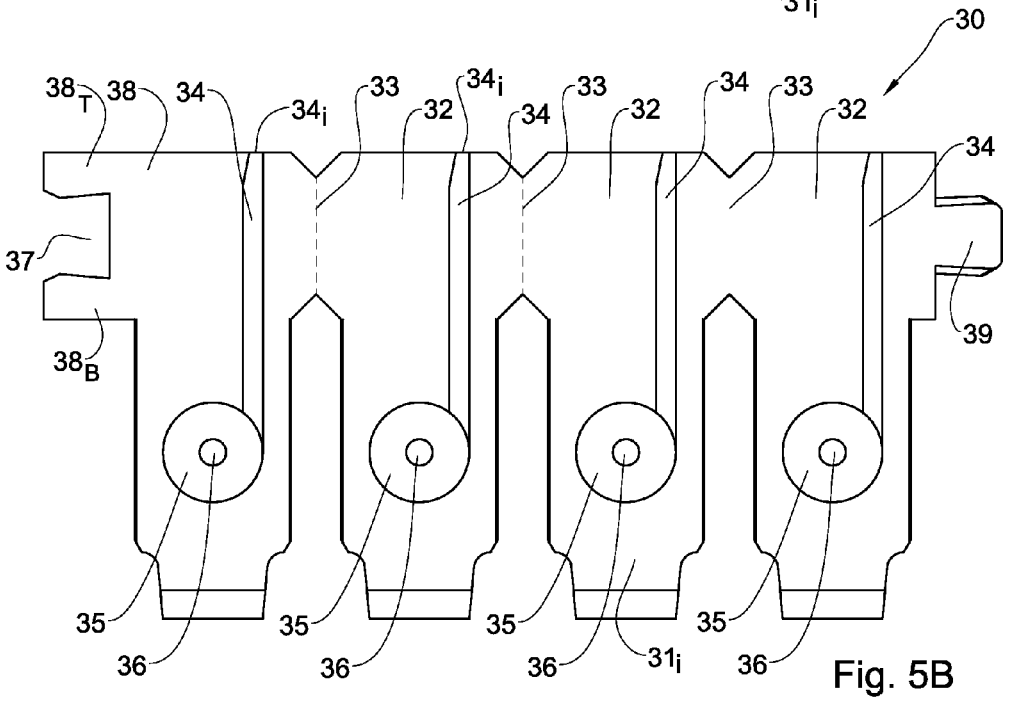
Figure 5C:
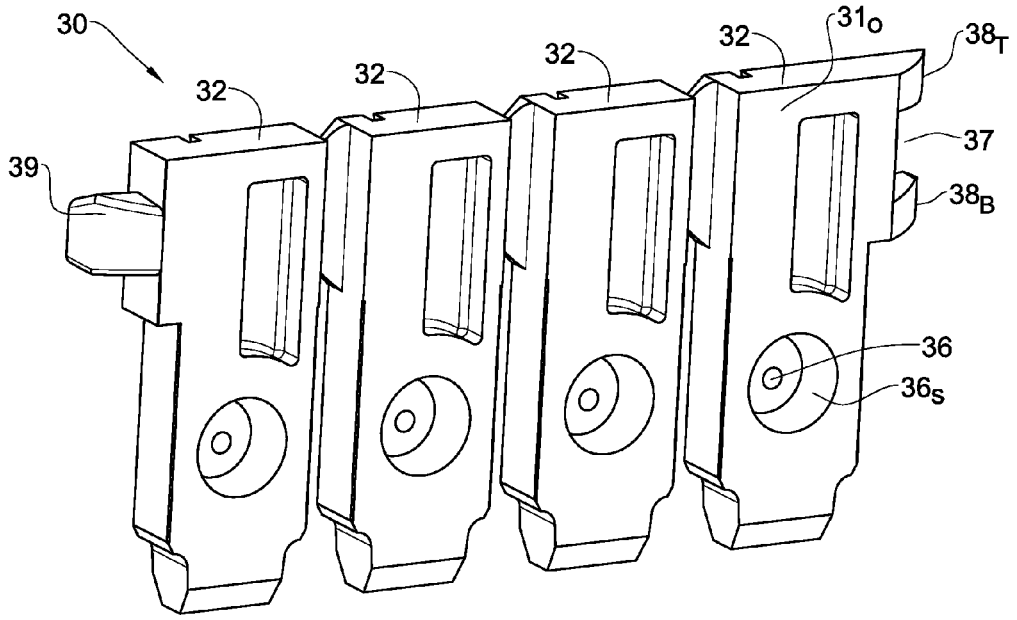
Figure 5D:
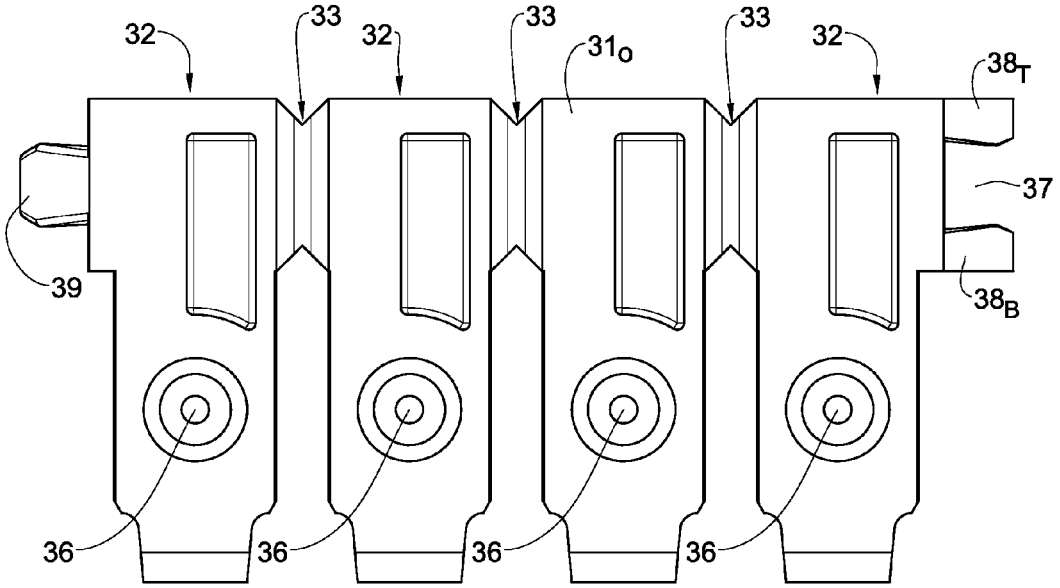
Figure 6A:
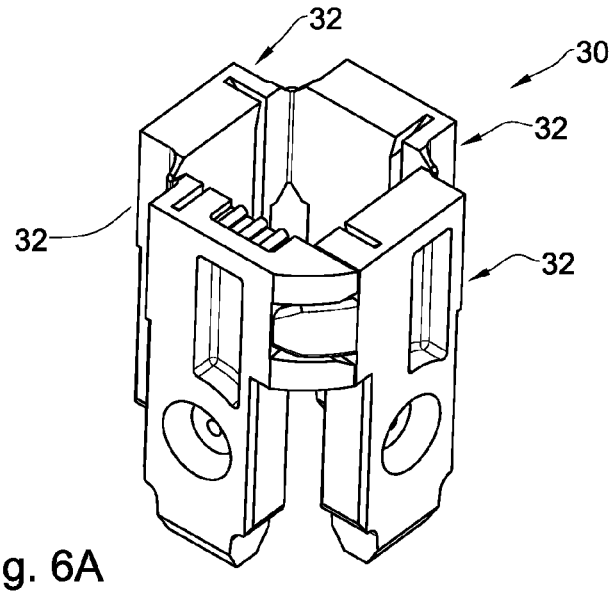
FIGS. 6A and 6B are schematic top and bottom isometric views of the vortex generating member array shown in FIGS. 5A to 5D.
Figure 6B:
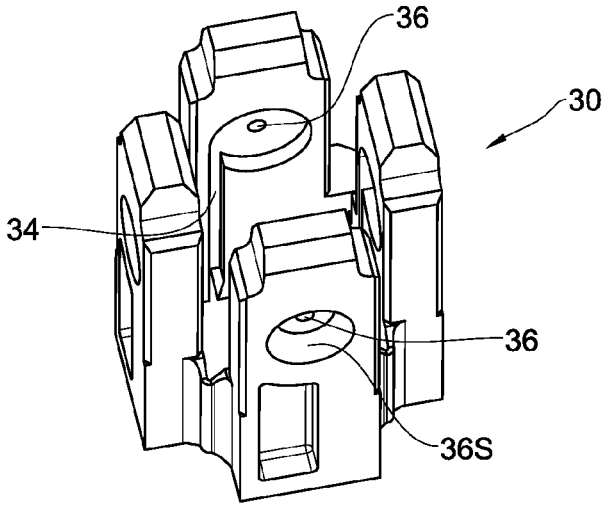
Figure 6C:
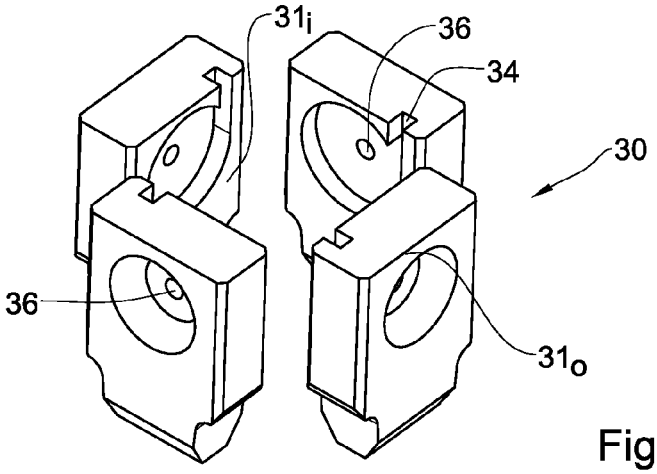
FIG. 6C is a schematic cross-sectional view of the vortex generating member array shown in FIGS. 6A and 6B, taken along a plane perpendicular to a longitudinal axis of the atomizer.
Figure 7A:
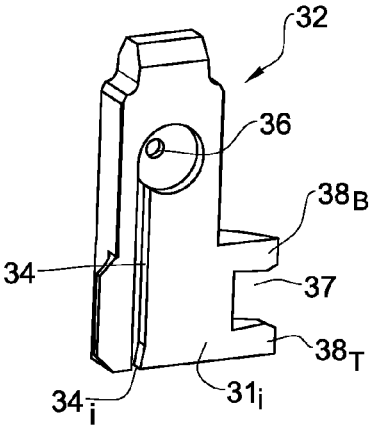
FIG. 7A is a schematic front isometric view of a single vortex generating member of the vortex generating member array shown in FIGS. 6A and 6B.
Figure 7B:
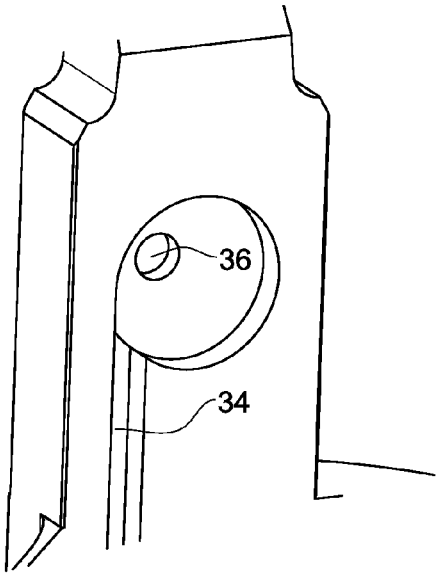
FIG. 7B is a schematic enlarged view of a portion of the single vortex generating member shown in FIG. 7A.
Figure 7C:
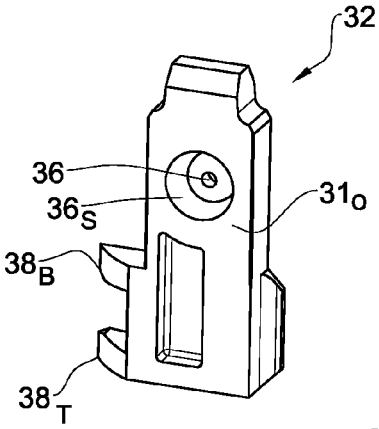
FIG. 7C is a schematic rear isometric view of a single vortex generating member of the vortex generating member array shown in FIGS. 6A and 6B.
Figure 7D:
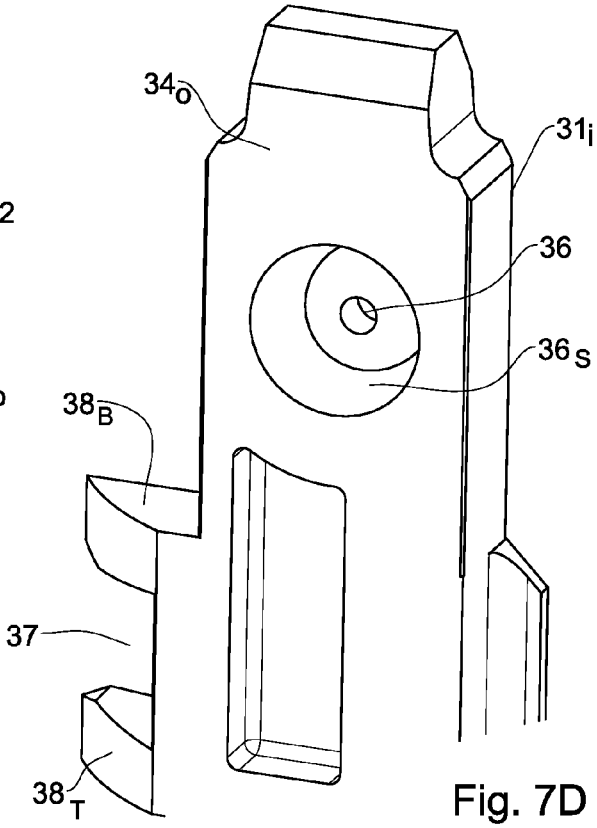
FIG. 7D is a schematic enlarged view of a portion of the single vortex generating member shown in FIG. 7C.
Figure 8A:
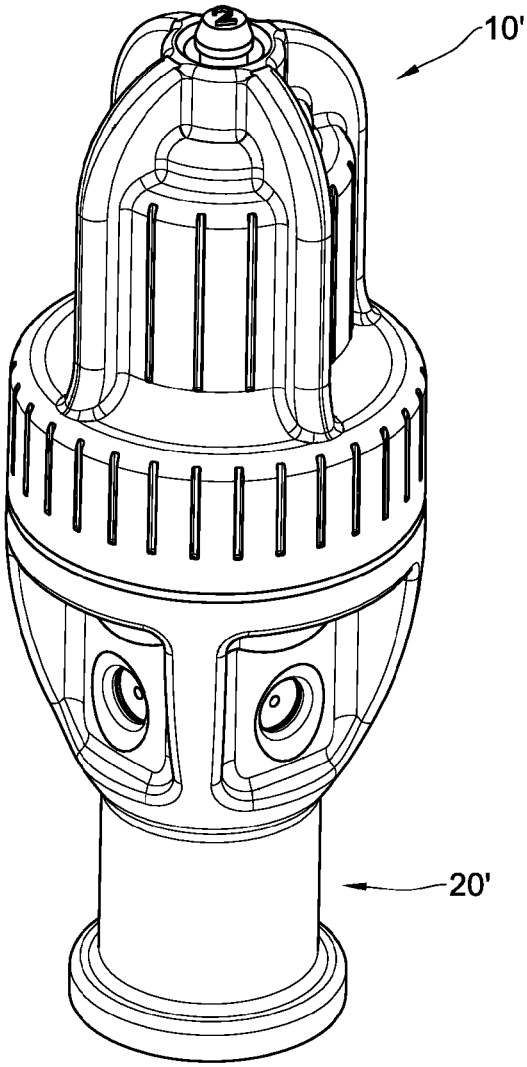
FIG. 8A is a schematic isometric view of a liquid atomizer according to another example of the present application.
Figure 8D:
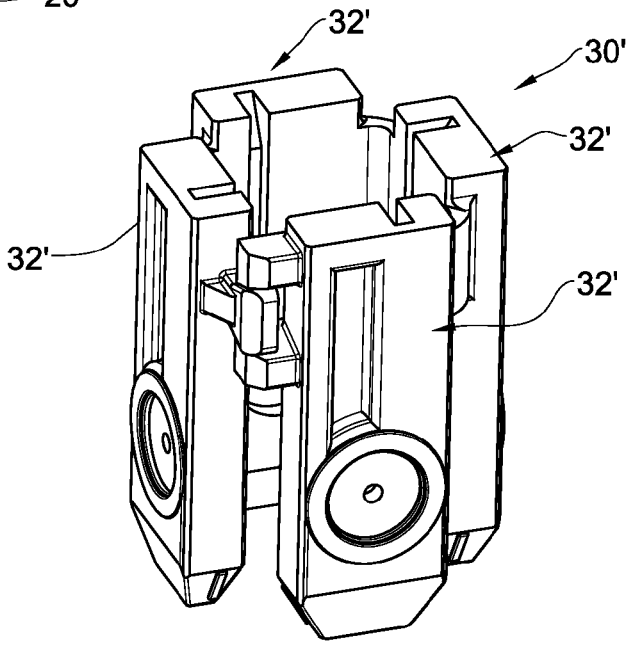
FIG. 8D is a schematic isometric view of the vortex generating members shown in FIGS. 8B and 8C, shown in their folded position.
Figure 8B:
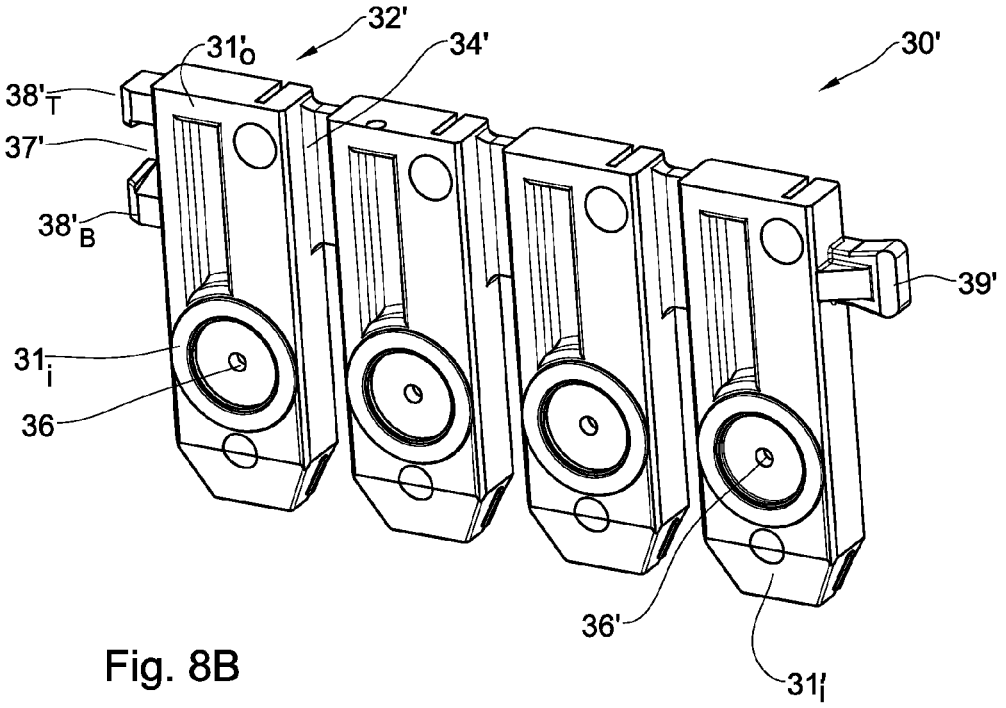
FIGS. 8B and 8C are schematic front and rear isometric views, respectively, of a set of vortex generating members used in the liquid atomizer shown in FIG. 8A, shown in their unfolded position.
Figure 8C:
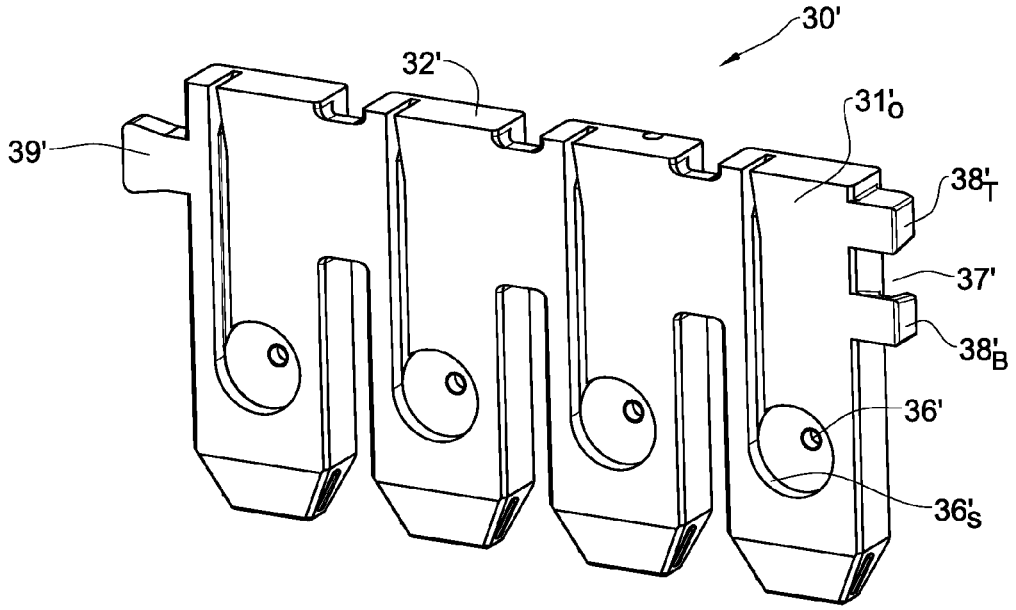

Owing to this arrangement, the vortex generating unit 30 can assume a first, manufacturing position as shown, for example, in FIG. 5A in which the four vortex generating members 32 lie along a mutual plane, and at least one operational position as shown, for example, in FIG. 2A, in which at least two of the vortex generating members 32 are angled to one another. In the particular example shown in FIG. 2A, all vortex generating members 32 are angled to one another at 90° to form a rectangular structure.

Each of the vortex generating members 32 has an inner surface 31*i* and an outer surface 31*o*, the terms 'inner' and 'outer' being defined with respect to the position in which the vortex generating members 32 are positioned within the atomizer 1.

Each vortex generating member 32 is formed on the inner surface 31*i* thereof with a flow path 34 leading to a vortex cavity 35 configured for circulating fluid incoming from the flow path to generate a vortex. The vortex cavity 35 is formed with an emission hole 36 extending between the inner surface 31*i* and the outer surface 31*o*.

The outer surface 310 of the vortex generating member 32 is formed with an outlet nozzle 36*s*, configured for allowing emission of the fluid exiting the emission hole 36.

In addition, it is observed that that rightmost vortex generating member 32 is formed with a closing latch 39 and the leftmost vortex generating member 32 is formed with a receiving portion having an upper and a lower projections 38T, 38B respectively, with a gap 37 extending therebetween and configured for receiving therein the latch 39. This arrangement allows securing the vortex generating unit 30 in the second, operational position (rectangular configuration).

Turning now to FIGS. 4A to 4E, the housing 20 is shown comprising a body 22 with a central axis X extending therealong, and having four side walls 31 forming a generally rectangular shape. Each of the four side walls is formed with an opening 28, configured for allowing emission therethrough of the fluid emitted from the outlet nozzle 36 of the vortex generating members 32.

It should be noted here that whereas the outlet nozzles 36 of the vortex generating members 32 are configured for functional use as nozzles, i.e. for directing the flow emitted from the vortex cavity 35, the openings 28 of the housing are simply configured for allowing the emitted fluid to pass unobstructed to the outside of the housing 20.

Figure 4C:
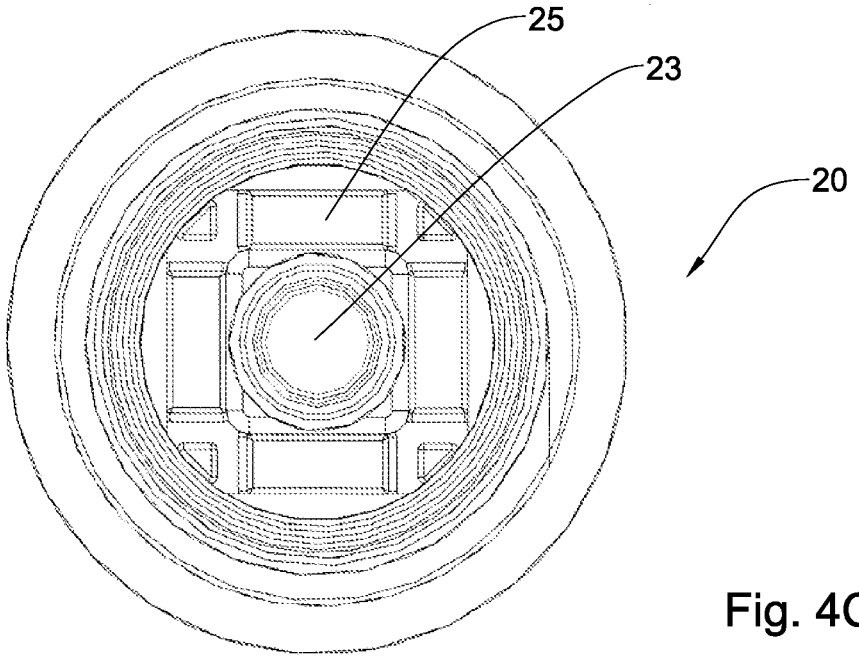
Figure 4D:
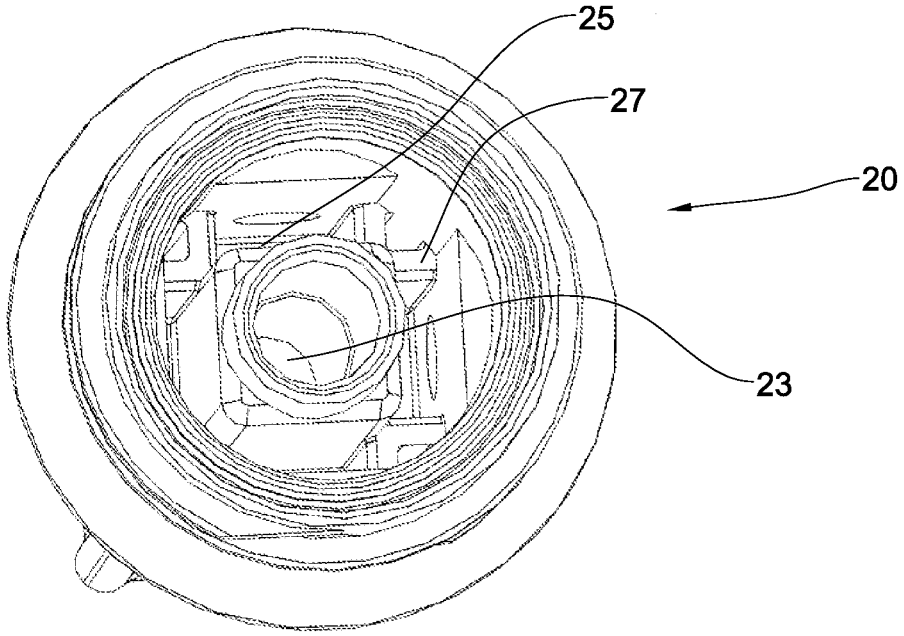
Figure 4E:
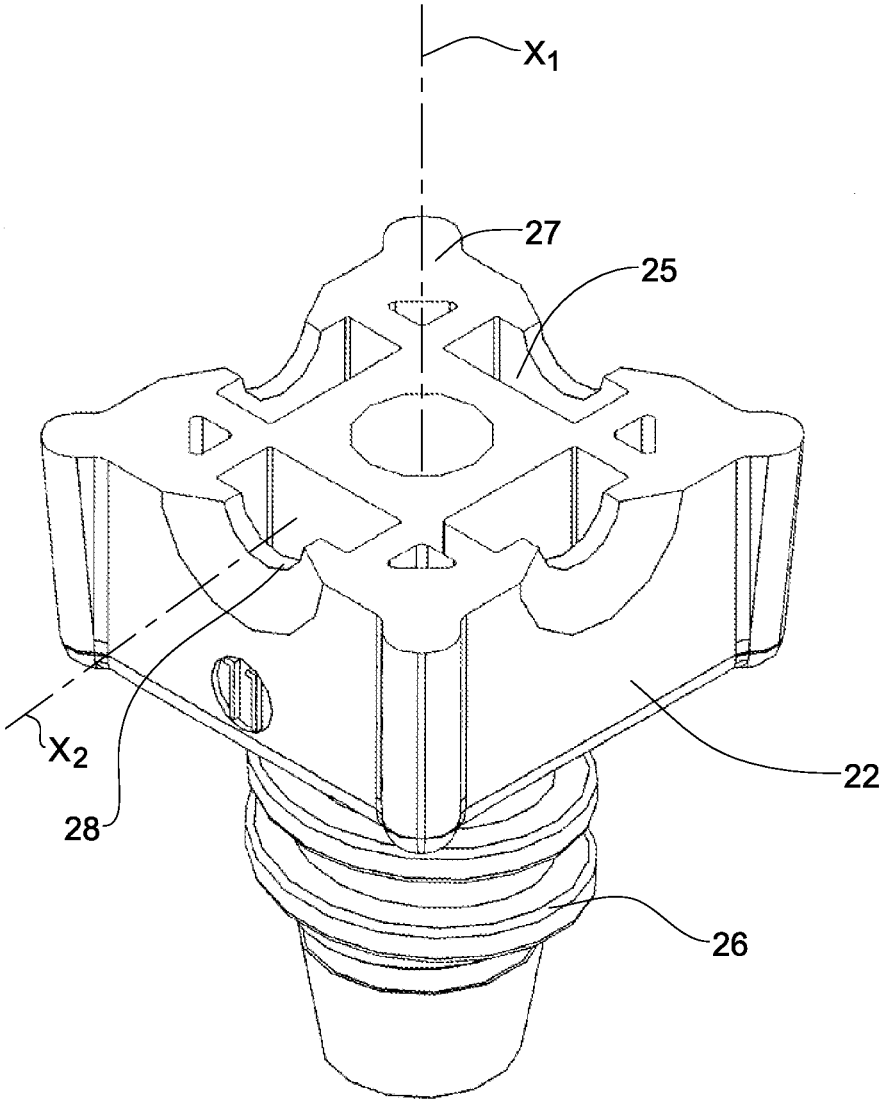
FIG. 4E is a schematic cross-sectional view of the housing shown in FIGS. 4A to 4D, taken along a plane perpendicular to a longitudinal axis of the atomizer.

The housing 20 is further formed with an inner cavity 23, configured for accommodating the vortex generating unit 30. With particular reference to FIGS. 4C to 4E, the inner cavity 23 is formed with four pockets 25, each being configured for sealingly accommodating a vortex generating member 32. The arrangement is such that each opening 28 is aligned with a pocket 25.

Figure 2B:
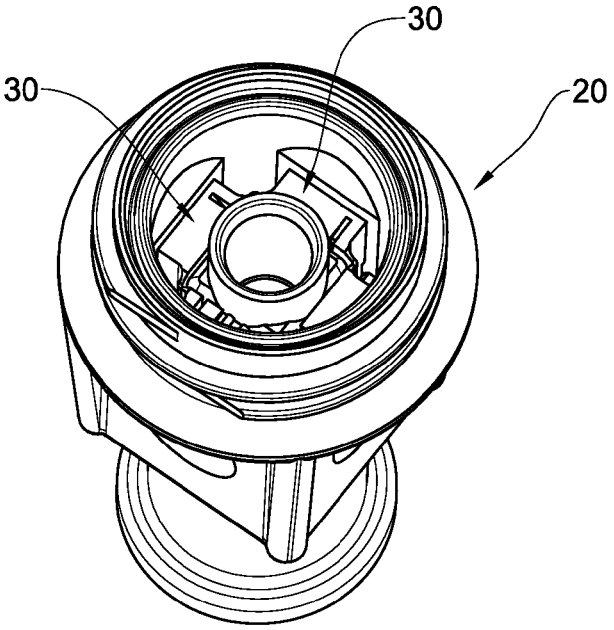
FIG. 2B is a schematic isometric view of the atomizer shown in FIG. 1A, with a cover thereof being removed.
Figure 2C:
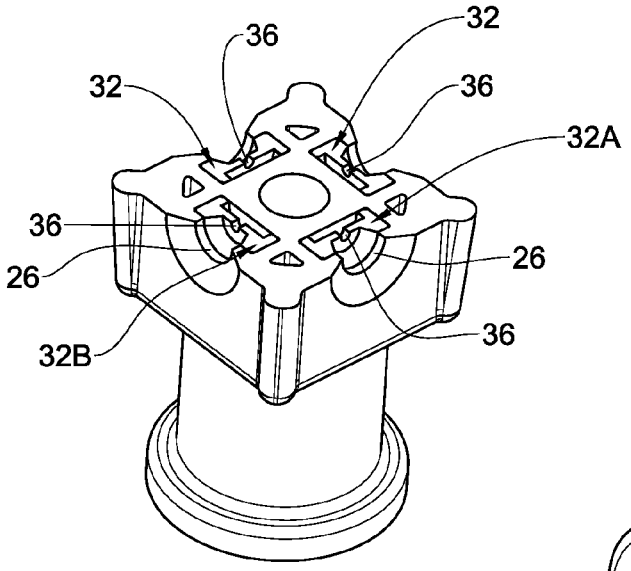
FIG. 2C is a schematic isometric cross-sectional view of the atomizer shown in FIG. 2B, taken along a plane perpendicular to a longitudinal axis of the atomizer.
Figure 3A:
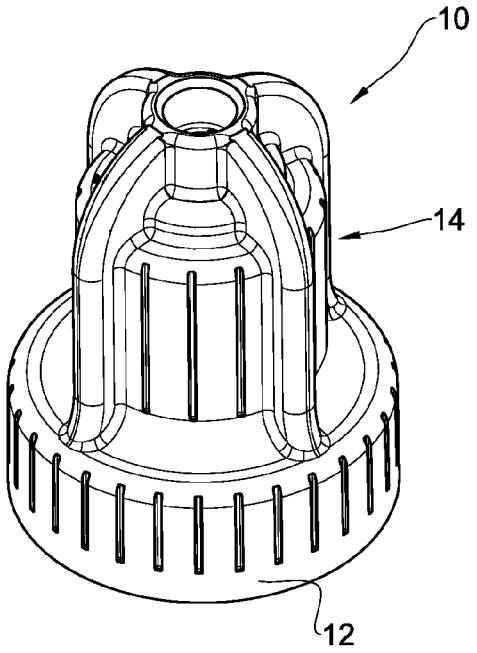
FIGS. 3A and 3B are schematic top and bottom isometric views of a cover of the atomizer show in FIG. 2A.
Figure 3B:
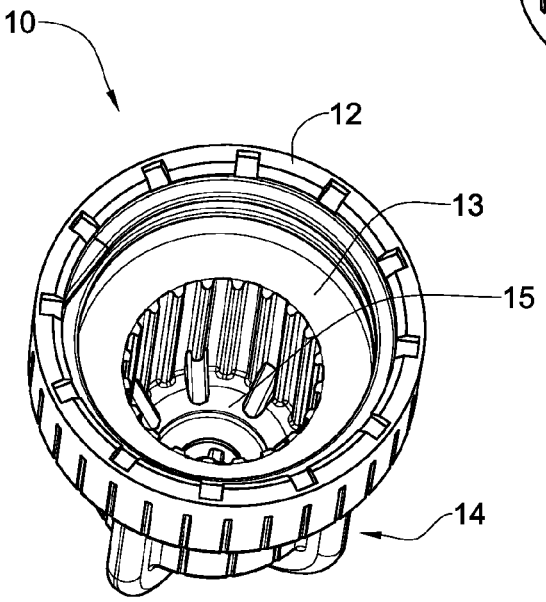

Reverting to FIGS. 2B and 2C, when the vortex generating unit 30 is accommodated within the housing 20, each vortex generating member 32 is accommodated within a corresponding pocket 25, so that the outlet nozzle 36 and opening 28 are aligned with one another.

It is noted that when the vortex generating unit 30 is positioned within the housing 20, the vortex generating members 32 are arranged such that the flow path 34 has its inlet end 34*i* facing the inlet cap 10. Further, the outer surface 310 is mated against the inner surface of the side wall 21 of the housing 20, thereby providing the desired sealing between the vortex generating members 32 and the housing 20.

The housing 20 is further formed with a central conduit C, configured for providing fluid from the inlet 26 to the cap 10 and the LPD.

In operation, the fluid enters the atomizer 1 from the inlet 26 and passes through the conduit C into the inlet cap 10. Upon sufficient pressure and deformation of the diaphragm 64, the fluid enters the housing 20 and, due to the sealing manner in which the vortex generating members 32 are arranged in, flows into the flow path 34 of each vortex generating member 32.

Once the fluid enters the flow path 34 and reaches the vortex cavity 35, it is spun within the vortex cavity and emitted via the outlet nozzle 36 to the outside. It is important to note that the openings 28 are configured solely for not obstructing the fluid flow emitted from the nozzle 36, i.e. they are not configured for affecting the fluid flow at all.

However, it should be noted that one of the vortex generating members 32 may be replaced with a 'dummy' member (not shown) which has no outlet nozzle 36 or even a flow path. Thus, it can be possible to selectively determine which sides of the atomizer fluid will be discharged through. In this case, if one vortex generating member is replaced with a 'dummy' member, the atomizer will be effective to discharge fluid via three directions only (the fourth being blocked by the 'dummy' member).

According to the above configuration, the entire functional operation of generating the vortex and emitting it is performed by the vortex generating members 32 and the side walls 21 of the housing.

It is appreciated that the above arrangement provides, inter alia, the advantage of manufacturing a single element (vortex generating member 32) which encompasses the functional features responsible for the fluid flow, i.e. both the nozzle and the vortex generating path an cavity are formed within a single body.

Reference is now made to FIGS. 8A to 8D, in which another example of an atomizer is shown, generally designated 1'. All elements of the atomizer 1' which are equivalent to those of the atomizer 1 have been accorded the same designation number with the addition of a prime (').

The atomizer 1' differs from the previously described atomizer 1 in the shape of the housing 20', which has a rounded configuration, thereby reducing the amount of material (and hence costs) as well as providing a less space consuming example.

In addition, the vortex generating members 32' are provided with a slightly different latch configuration 38', 39'.

Whilst preferred embodiments have been shown and described, it is to be understood that it is not intended thereby to limit the disclosure of the invention, but rather it is intended to cover all modifications and arrangements falling within the spirit and the scope of the invention, mutatis mutandis.

The invention claimed is:

1. A liquid atomizer, comprising:

a housing fitted with an inlet connectable to a liquid supply line and a cavity being in flow communication with the inlet, said cavity having a longitudinal axis; the housing, comprising:

at least one opening for emitting atomized liquid; and at least one vortex generating member formed with a vortex generating path being in flow communication with the cavity and extending opposite a respective opening of the housing; said at least one vortex generating member having an inside surface facing said cavity and an opposite, outside surface facing away from said cavity, the inside surface of the vortex generating member being associated with the vortex generating path and comprises at least one outlet nozzle being in fluid flow communication with said vortex generating path via an opening extending between said inside surface and said outside surface, said vortex generating path being configured for generating a liquid vortex directed towards said opening to be emitted from said outlet nozzle generally along the transverse direction.

2. The liquid atomizer according to claim 1, wherein the housing is fitted with a plurality of vortex generating members, the members being disposed about the axis of the housing.

3. The liquid atomizer according to claim 1, wherein said vortex generating member is sealingly received without the housing, so that fluid within the cavity can only flow into the vortex generating path.

4. The liquid atomizer according to claim 1, wherein the opening formed in the housing is of circular shape.

5. The liquid atomizer according to claim 1, wherein the vortex generating member is configured for being snapingly fixed to the housing.

6. The liquid atomizer according to claim 1, wherein the vortex generating member is configured to be displaced into different functional positions within the housing.

7. The liquid atomizer according to claim 1, wherein the inside surface of the vortex generating member is configured to sealingly bear against corresponding inner walls of the housing.

8. The liquid atomizer according to claim 7, wherein a sealing member is introduced between the vortex generating member and the housing.

9. The liquid atomizer according to claim 1, wherein the vortex generating path formed on the inside surface of the vortex generating member is sealingly delimited on one side by the body of the vortex generating member and on the other side by an inner wall of the housing.

10. The liquid atomizer according claim 1, wherein the outside of the vortex generating member sealingly bears against inside surfaces of the housing.

11. The liquid atomizer according to claim 1, wherein the outlet nozzle of the vortex generating member is aligned with the opening of the housing.

12. The liquid atomizer according to claim 1, wherein a plurality of vortex generating members is provided within the housing, the plurality of vortex generating members being integrally formed with one another in a flexible manner.

13. The liquid atomizer according to claim 12, wherein the plurality of vortex generating members are in the form of a single body comprising living hinge portions being formed between two neighboring vortex generating members.

14. The liquid atomizer according to claim 1, wherein the vortex generating member comprises a plurality of vortex generating paths and a plurality of outlet nozzles.

15. The liquid atomizer according to claim 1, wherein the inlet is provided with a pressure threshold valve received before or after the inlet.

16. The liquid atomizer according to claim 15, wherein the pressure threshold valve is received within the cavity of the liquid atomizer.

17. The liquid atomizer according to claim 15, wherein the pressure threshold valve comprises a closure member biased against the inlet of the housing.

18. The liquid atomizer according to claim 15, wherein the pressure threshold valve is a leakage preventing device (LPD), wherein the closure member is spring biased against the inlet of the housing and has a piston rod connecting it with a piston, said piston being displaceable along a corresponding cylinder, which is in flow communication with the cavity.

19. The liquid atomizer according to claim 18, wherein the LPD arrangement provides for opening of the closure member at a predetermined pressure threshold wherein the inlet is rapidly opened into a maximal open stage.

20. The liquid atomizer according to claim 19, wherein the cylinder is vented to the atmosphere.

* * * * *